US007600619B2

(12) United States Patent
Sapyta

(10) Patent No.: US 7,600,619 B2
(45) Date of Patent: Oct. 13, 2009

(54) STORAGE CONTAINER AND DISPLAY SYSTEM FOR TOYS AND OTHER ITEMS

(75) Inventor: Rachel Sapyta, San Antonio, TX (US)

(73) Assignee: Perfect World Luggage, Inc., San Antonio, TX (US)

( * ) Notice: Subject to any disclaimer, the term of this patent is extended or adjusted under 35 U.S.C. 154(b) by 828 days.

(21) Appl. No.: 10/856,148

(22) Filed: May 28, 2004

(65) Prior Publication Data

US 2005/0016808 A1 Jan. 27, 2005

Related U.S. Application Data

(60) Provisional application No. 60/475,186, filed on Jun. 2, 2003.

(51) Int. Cl.
*A47C 7/00* (2006.01)

(52) U.S. Cl. ..... 190/107; 383/4; 224/583; 190/110; 190/109

(58) Field of Classification Search ..... 190/110, 190/107; 383/38, 39, 4; 224/583
See application file for complete search history.

(56) References Cited

U.S. PATENT DOCUMENTS

| | | | | |
|---|---|---|---|---|
| 1,061,374 | A | | 5/1913 | Harrington |
| 1,085,950 | A | | 2/1914 | Steinthal |
| 1,866,323 | A | | 7/1932 | Russel |
| 2,112,062 | A | | 3/1938 | Berger |
| 2,463,391 | A | | 3/1949 | Kanaley |
| 3,650,381 | A | | 3/1972 | Weindling |
| 4,287,986 | A | | 9/1981 | Beck |
| 4,386,642 | A | | 6/1983 | Durbin |
| 4,436,189 | A | | 3/1984 | Baum |
| 4,515,300 | A | * | 5/1985 | Cohen ..... 224/153 |
| 4,802,575 | A | * | 2/1989 | Martin ..... 206/232 |
| 4,852,293 | A | * | 8/1989 | Levine et al. ..... 43/54.1 |
| 4,874,119 | A | * | 10/1989 | Winter ..... 224/610 |
| 4,951,812 | A | | 8/1990 | Chen |
| 4,953,765 | A | * | 9/1990 | Little et al. ..... 224/583 |
| 4,967,913 | A | | 11/1990 | Bayer |
| 5,002,401 | A | | 3/1991 | Blackman |
| 5,123,197 | A | * | 6/1992 | Gentry et al. ..... 43/54.1 |
| 5,125,519 | A | | 6/1992 | Cambria |
| 5,125,523 | A | | 6/1992 | Kulper |
| 5,291,990 | A | | 3/1994 | sejzer |
| 5,350,045 | A | * | 9/1994 | Robertson ..... 190/110 |
| 5,489,021 | A | * | 2/1996 | Wallingford ..... 206/214 |
| 5,562,204 | A | | 10/1996 | Sapyta et al. |
| 5,799,791 | A | * | 9/1998 | Harley ..... 206/478 |
| 6,000,509 | A | * | 12/1999 | Chisholm ..... 190/109 |
| 6,244,400 | B1 | * | 6/2001 | Bowers ..... 190/110 |

(Continued)

FOREIGN PATENT DOCUMENTS

| | | |
|---|---|---|
| DE | 184586 | 5/1907 |

(Continued)

*Primary Examiner*—Tri M Mai
(74) *Attorney, Agent, or Firm*—Jackson Walker, LLP

(57) ABSTRACT

A luggage container comprising a foldable flat member. To the inner surface of the foldable flat member I releasable attached a number of pockets in which articles may be stored and/or displayed. A single, flat, foldable member can be folded into a generally rectangular shape or laid flat or hung vertically.

21 Claims, 8 Drawing Sheets

U.S. PATENT DOCUMENTS

| | | | | |
|---|---|---|---|---|
| 6,296,094 | B1 * | 10/2001 | Knecht | 190/107 |
| 6,523,653 | B2 * | 2/2003 | Roegner | 190/109 |
| 6,715,594 | B2 * | 4/2004 | Milionta et al. | 190/110 |
| 7,086,437 | B1 * | 8/2006 | Michael | 150/103 |
| 2002/0114539 | A1 * | 8/2002 | Strevey et al. | 383/13 |
| 2004/0134734 | A1 * | 7/2004 | Hollingsworth | 190/110 |

FOREIGN PATENT DOCUMENTS

| | | |
|---|---|---|
| FR | 2419692 | 11/1979 |
| GB | 162197 | 4/1921 |
| GB | 490148 | 8/1938 |

* cited by examiner

STORAGE CONTAINER AND DISPLAY SYSTEM FOR TOYS AND OTHER ITEMS

This application claims priority from and incorporates by reference U.S. provisional patent No. 60/475,186 filed Jun. 2, 2003.

FIELD OF THE INVENTION

A luggage container, more specifically a luggage container formable from a single flat, foldable member and containing a multiplicity of unique, releasably attachable pockets.

BACKGROUND OF THE INVENTION

Prior art discloses a myriad of luggage containers in a variety of designs and constructed of a variety of different materials. A simple luggage container may be nothing more than a sack, opened at the top for receipt of items therein. However, a need exists for a more complex luggage container that is capable of storing a variety of items. There exists, in the prior art, a variety of purpose built luggage containers such as that found in U.S. Pat. No. 5,562,204 (Sapyta 1997). The '204 luggage container, while it may be adapted for multipurpose use, is especially useful in the display of veterinary or medical items.

Applicant herein provides for a novel luggage container that is adapted for a specific purpose, yet may be useful for the storage, transportation and display of, in fact, a variety of items. More specifically, Applicant has invented a novel container that has been found to be suitable for among other things the storage, transportation and display of dolls or toys and their related accessories. However, Applicant has found that such a novel luggage container is also suitable for the transportation, storage and display of a variety of items including: toys, medical implements, cosmetics, jewelry and small personal items.

Applicant sought to achieve, in an inexpensive, easy to manufacture luggage container, the capability of storing a number of rather small items, as well as a fewer larger items. For example, a "Barbie®" doll set would typically include one or more large items (the doll itself), a number of additional clothing items to clothe the doll, which would represent smaller items, and a still greater number of even smaller items such as shoes, purses, hats, etc. It may be readily appreciated by those with young children that the organization, transportation and storage of such a multiplicity of various sized items, related to one another, without losing, them is formable. Simple boxes do not work as they mix up items of different sizes. Compartmentalized boxes do not work well either unless the compartments are appropriately sized and, even then, there is difficulty in mixing up fashion accessories related to one doll that would not fit or work with another. In addition to the size and number of different items, Applicant discovered that they need to be stored properly as well as easily transported from one place to another and, in such a fashion that they could be visible and associated with one another. This will help one find small items quickly and easily.

OBJECTS OF THE INVENTION

Thus, it was the object of the present invention to provide for a myriad of transportation and storage advantages in a simple, easy to use and easy to manufacture luggage container. The term luggage is used in a broad sense, a container capable of carrying a variety of items be they toy items, clothing articles, cosmetics, salesman samples or other materials.

Applicant has achieved these objects and others in providing for a luggage container having a multiplicity of removable "see through" pockets.

These objectives and others are provided for in a luggage container that contains a multiplicity of "see through" pockets that are removable and that come in a variety of sizes and shapes.

These objects and others are provided for in a novel luggage container having a multiplicity of leaf pockets as well as a multiplicity of bulk pockets. The term leaf pockets is included herein by Applicant to describe a tabular pocket, being substantial in length and width, but rather narrow in thickness. On the other hand, bulk pockets are substantial in length, width and height and more capable of carrying bulky items therein. Leaf pockets may be more suitable for a number of smaller items or for items that may be more flat laying than bulkier items. For example, a doll itself is bulky and thus would be better adapted for receipt into a bulk pocket. On the other hand, a skirt, dress or other fashion outfit which is made of a flexible fabric and may be essentially flat laying, is often adapted for receipt into a leaf pocket. Both bulk and leaf pockets, provided with walls that are transparent or at least translucent, provide the user with a clear view of the contents thereof and thus are simpler to use than an opaque pocket which would require opening and sorting through the items for proper identification of the desired object.

These and other objects are provided for in a flat laying panel having foldable sections, upon which an inner surface has removably attached thereto a multiplicity of leaf and bulk pockets in a variety of sizes and, wherein folding of the panel will provide for the capability of easy carrying when in a folded condition or display and/or use when in an unfolded position.

To achieve the stated objectives and others, Applicant has provided a novel combination of features that include a flat laying panel capable of being easily folded into a container shape (typically rectangular), the flat laying panel having a multiplicity of clear removable pockets in a variety of shapes. Applicant has further provided for achieving these and other objectives a novel arrangement of the pockets which may be arranged as leaves in a book, for ease of identifying the contents thereof and for ease of removing a pre-selected one from a multiplicity of leaf pockets.

DETAILED DESCRIPTION OF THE PREFERRED EMBODIMENT

Figure 1:
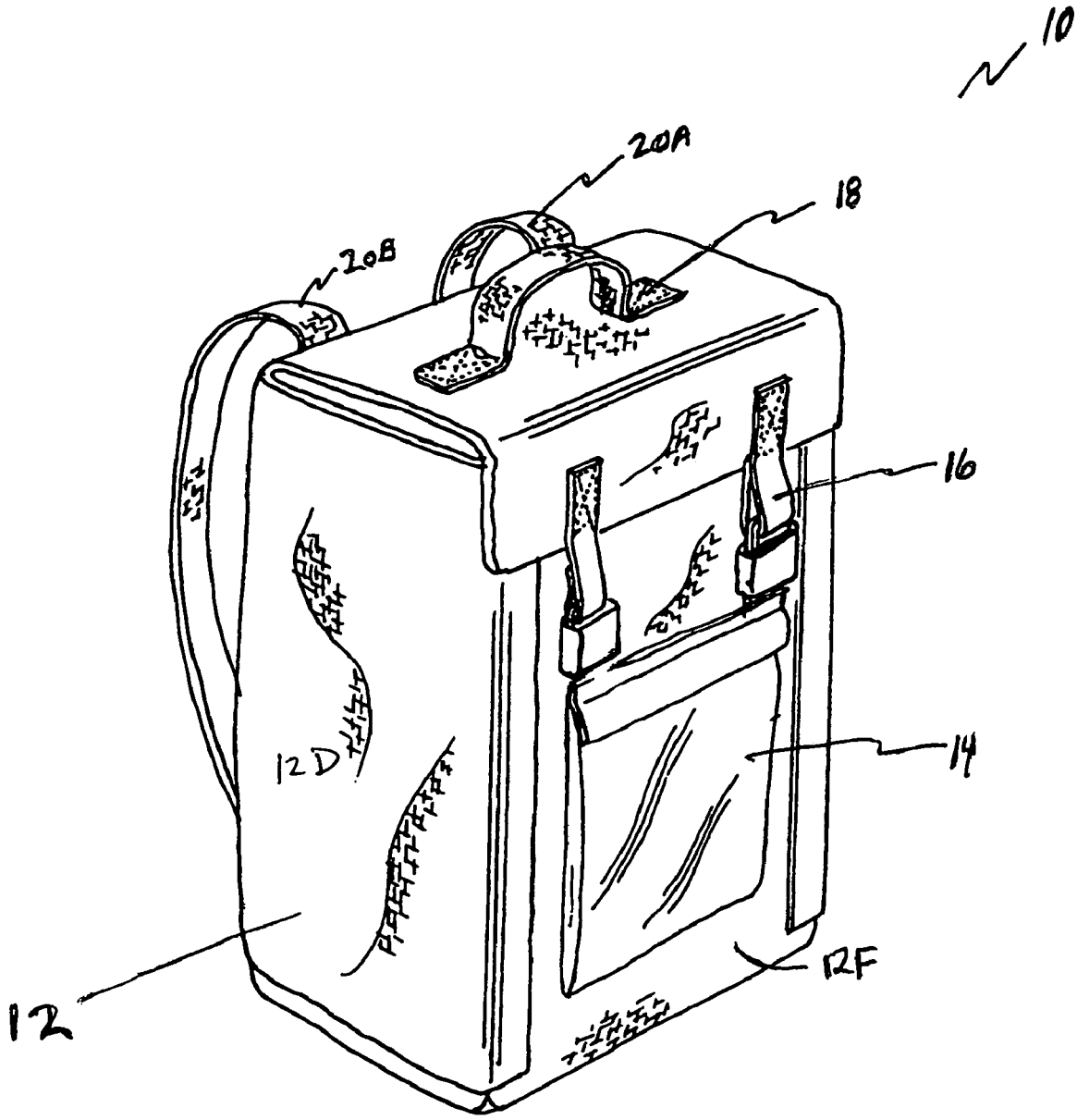
FIG. 1 is a perspective view of the novel luggage container of Applicant's present invention in a folded condition.

Turning now to FIG. 1, it is seen that Applicant provides a container (10) which may be generally rectangular and comprised of a panel (12), the panel comprising the walls of the generally rectangular container. Optionally, one or more external pockets (14) may be provided, which external pockets may be attached on one more of the external walls of the container. The container comprises a panel which may be folded to define the generally rectangular structure illustrated in FIG. 1 and may also include buckles (16) clips or other fasteners for buckling and unbuckling and providing access to the container or for laying the container out flat as set forth in FIG. 2. In addition, the container may have either a handle (18) and/or carrying straps (20A and 20B), for carrying the container as a backpack, the handle for carrying it as a hand bag. The container may have either a handle, or carrying straps or both. Indeed, in certain configurations, there may be no handle or straps, yet typically there will one or the other or both. These will provide for easy carrying of the container and the objects stored therein.

With reference to FIGS. 1, 2, 2A and 3 panel (12) is seen to include an outer surface (12A) and an inner surface (12B). Moreover, when the panel is folded into the rectangular shape illustrated in FIG. 1, the panel may define the back wall (12C), two side walls (12D), bottom wall as well as a combined bottom end/rear wall (12F). In an alternate preferred embodiment not illustrated, side walls (12D) may be omitted.

Figures 2, 2A:
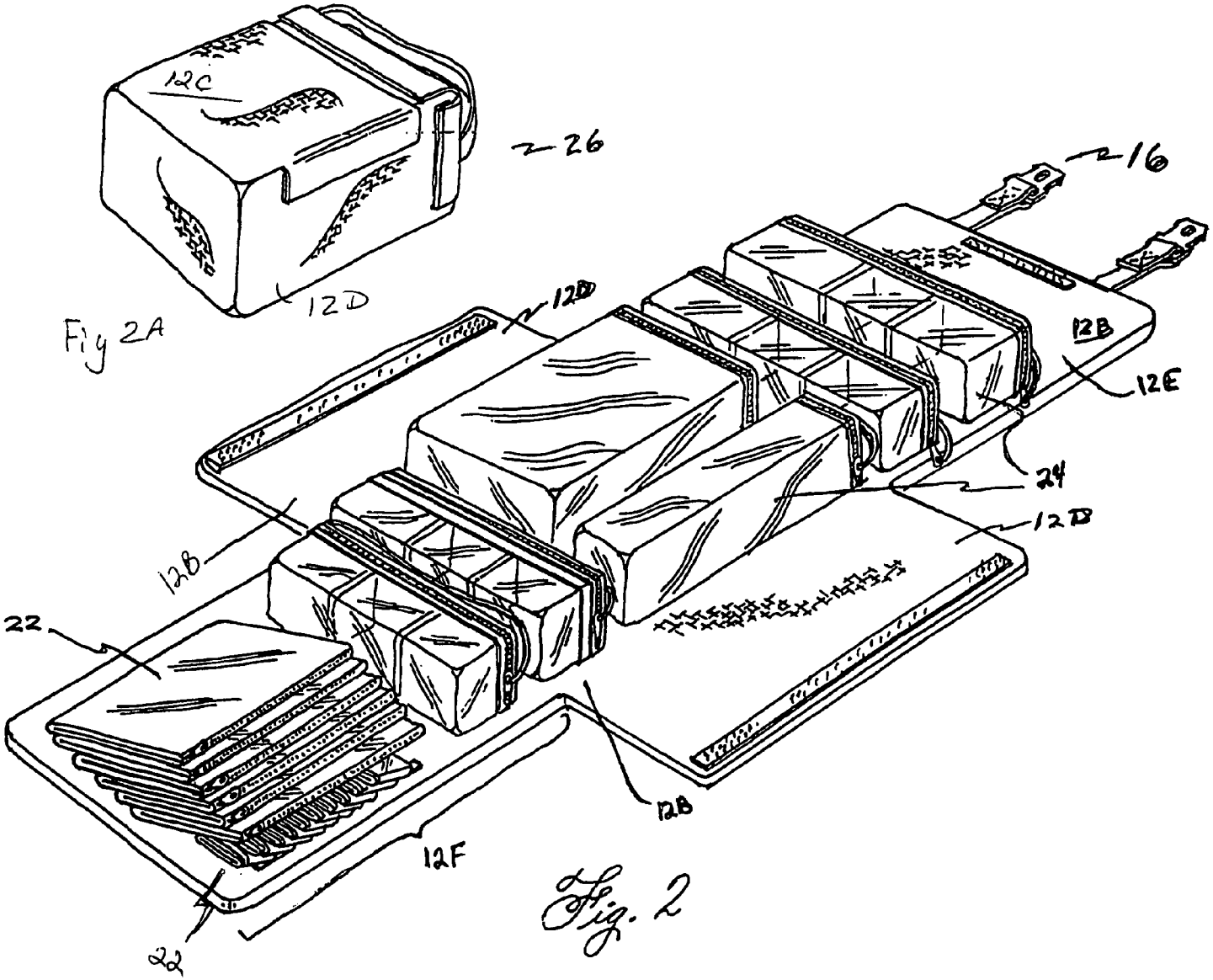
FIG. 2 is a perspective view of the inner surface of the panel of Applicant's novel container in an unfolded view and illustrating the pockets thereof.
FIG. 2A illustrates a bulky pocket in perspective view.

FIG. 2 illustrates multiplicity of pockets attached removably, as by Velcro or the like, to at least part of the inner surface (12B) in such a manner that the pockets may contain contents yet the panel may be folded in a position illustrated in FIG. 1. Velcro® comes in mating pads and is a well known hook and pile type fastener. The dashed lines in FIG. 3 define the fold lines of the panel.

Figure 8:
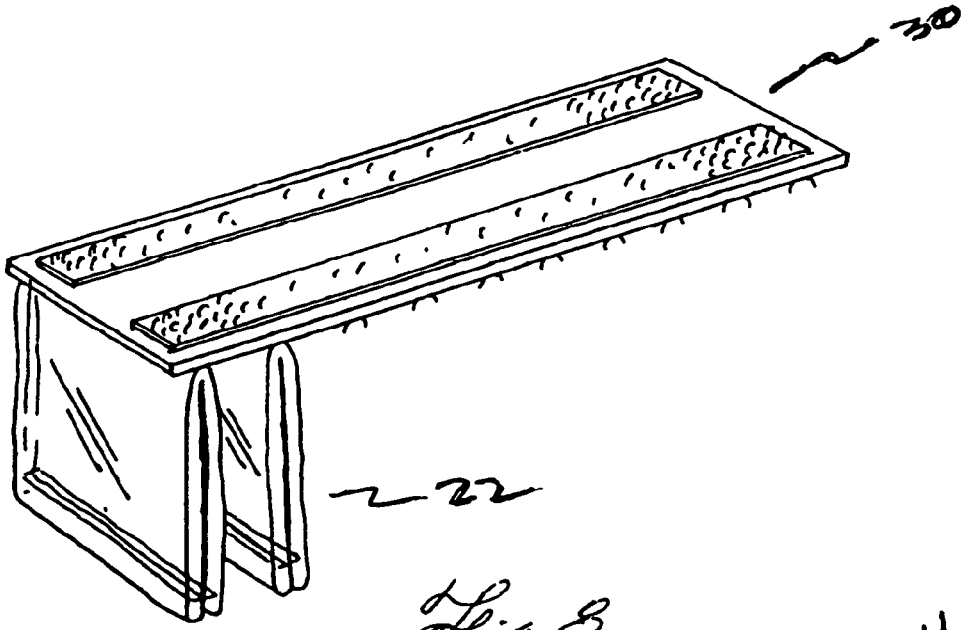
FIGS. 8 and 8A are perspective views of a manner of organizing a multiplicity of pockets for attachment to the panel and for removal from the panel as a group.

Turning back to FIG. 2, it is seen that internal leaf pockets (22) may be directly attached to the inner surface of panel (12) and arranged one to the other in "book" fashion as seen in FIG. 2. Indeed, FIG. 2 illustrates two "sheaths" or "books" comprising a multiplicity of leafpockets arranged so that a spine thereof may be attached either directly to the inner surface of the panel or to a mounting panel which is in turn attached to the inner surface. Moreover, leaf pockets may be attached so that a zipper or Velcro-sealed edge is opposite that edge, spine or portion bound to either the panel or a mounting surface (see FIGS. 8 and 8A). Reference to FIG. 2 illustrates the tabular nature of the panels and the slim design of the leaf pockets. FIG. 2 also illustrates the bulky nature of bulk pockets (24).

Figure 4:
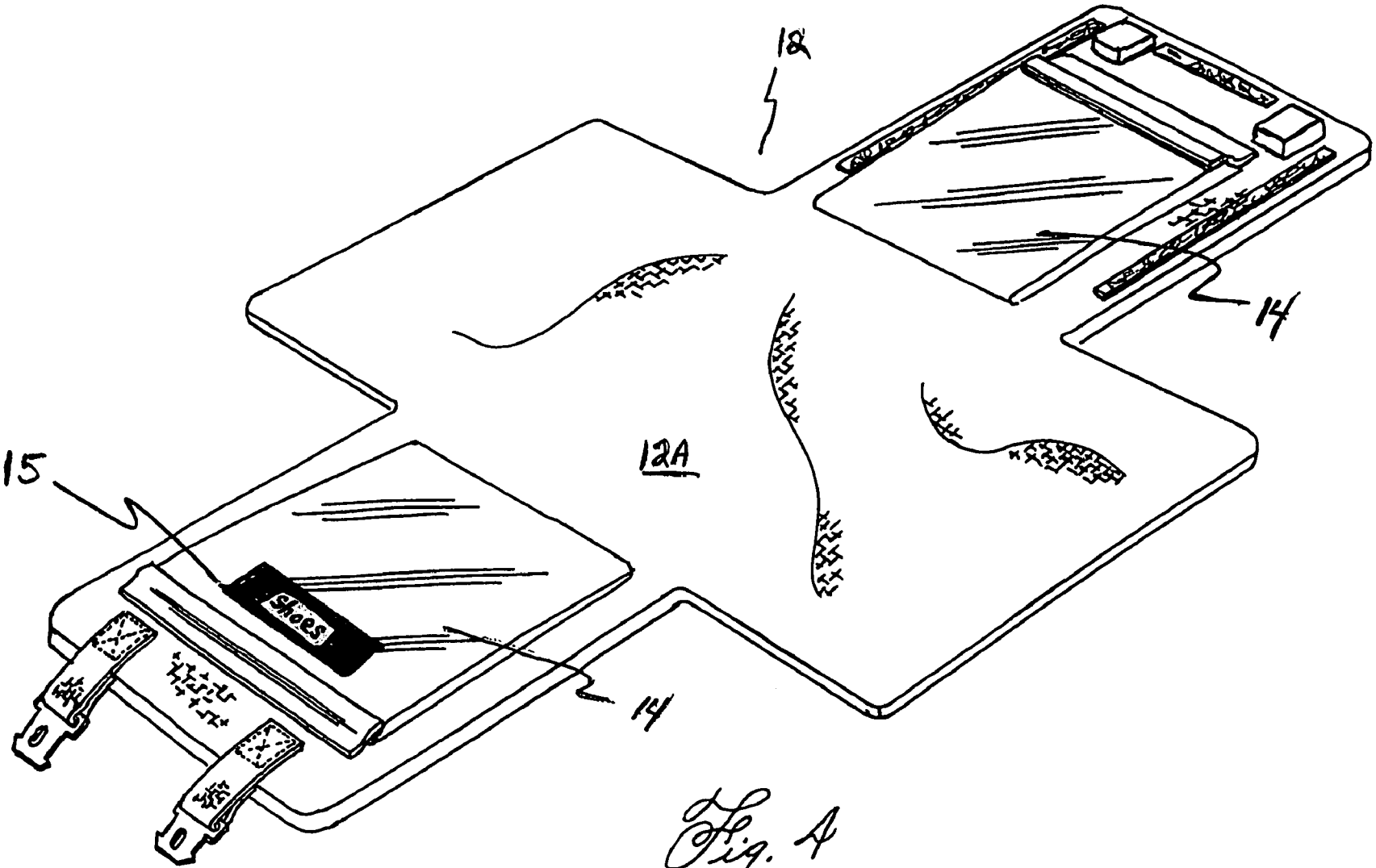
FIG. 4 is a perspective view of the panel of Applicant's container in an unfolded condition illustrating the outer surface and illustrating external pockets on a surface thereof.

Turning now to FIG. 4, it is seen that Applicant provides for, in a preferred embodiment, one or more externally mounted tabular pockets having at least an outer wall comprised of a see through material such as clear vinyl, here external pockets (14) being attached to rear wall (12F) and back wall (12C) (external surface thereof). External pockets (14) may be constructed in any fashion and be removably (preferable) or permanently attached. External pockets are an option feature of applicant's invention. Identification tab, insert, or name tag (15) may be included on some or all of the pockets, as for example, adhesive backed paper, to allow the user to identify the intended contents of the pocket.

Figure 5:
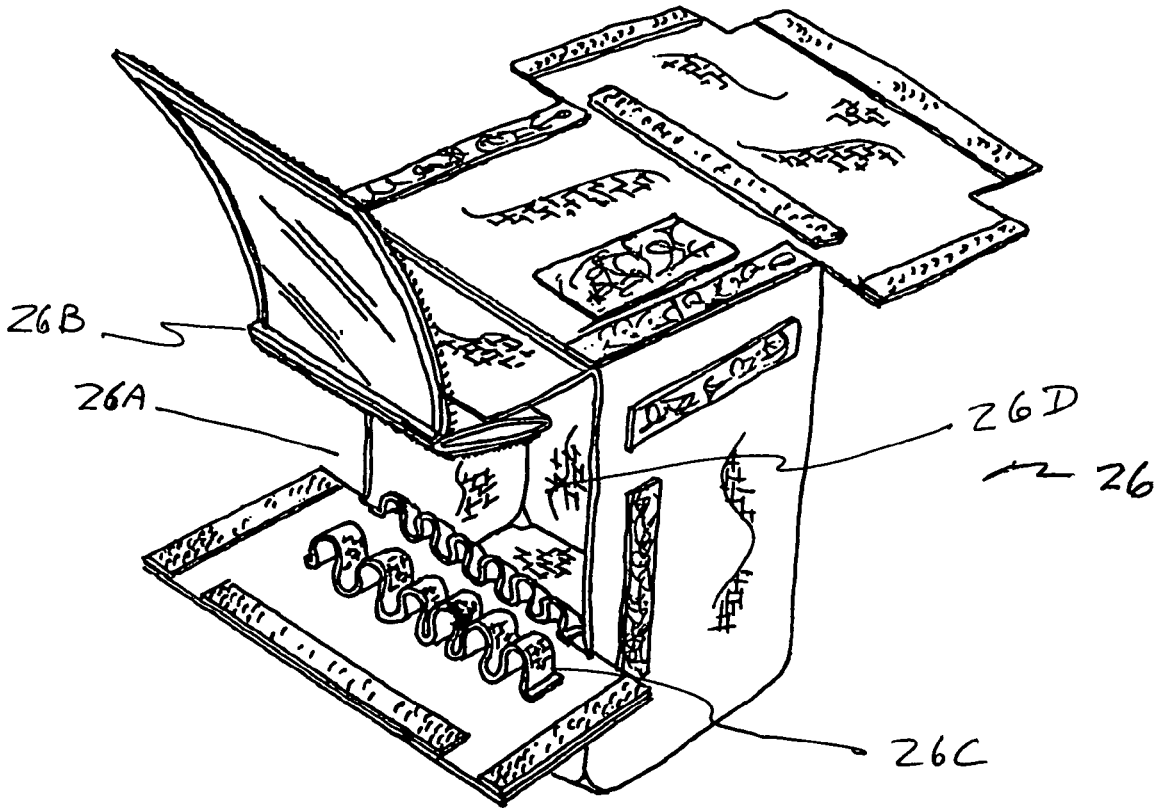
FIG. 5 is a perspective view of an example of one possible insert pack for use with Applicant's novel luggage container which insert pack is dimensioned for receipt onto the inner surface of the panel.

An optional feature of the preferred embodiment of Applicant's invention is an insert pack (26) illustrated in FIG. 5, which is in itself a small container which may be dimensioned to be received, removably, upon the inner surface of panel (12) when one or more of the pockets featured in FIG. 2 are removed. This gives Applicant's container (10) a degree of flexibility wherein one may choose to remove a series of pockets therefrom and instead place insert pack (26) therein. It is seen that insert pack is generally rectangular and, when sitting on a bottom wall, may open from the front (as opposed to opening from the top), to display the contents thereof. Insert pack (26) is a "pack within a pack," dimensioned small enough to fit with Applicant's container (10), and may itself include one or more of the features of Applicant's novel container. Here, FIG. 5 illustrates pockets (26B) and retainer loops (26C) as well as an interior volume (26D) for receipt of items therein.

Figures 6, 6A, 6B:
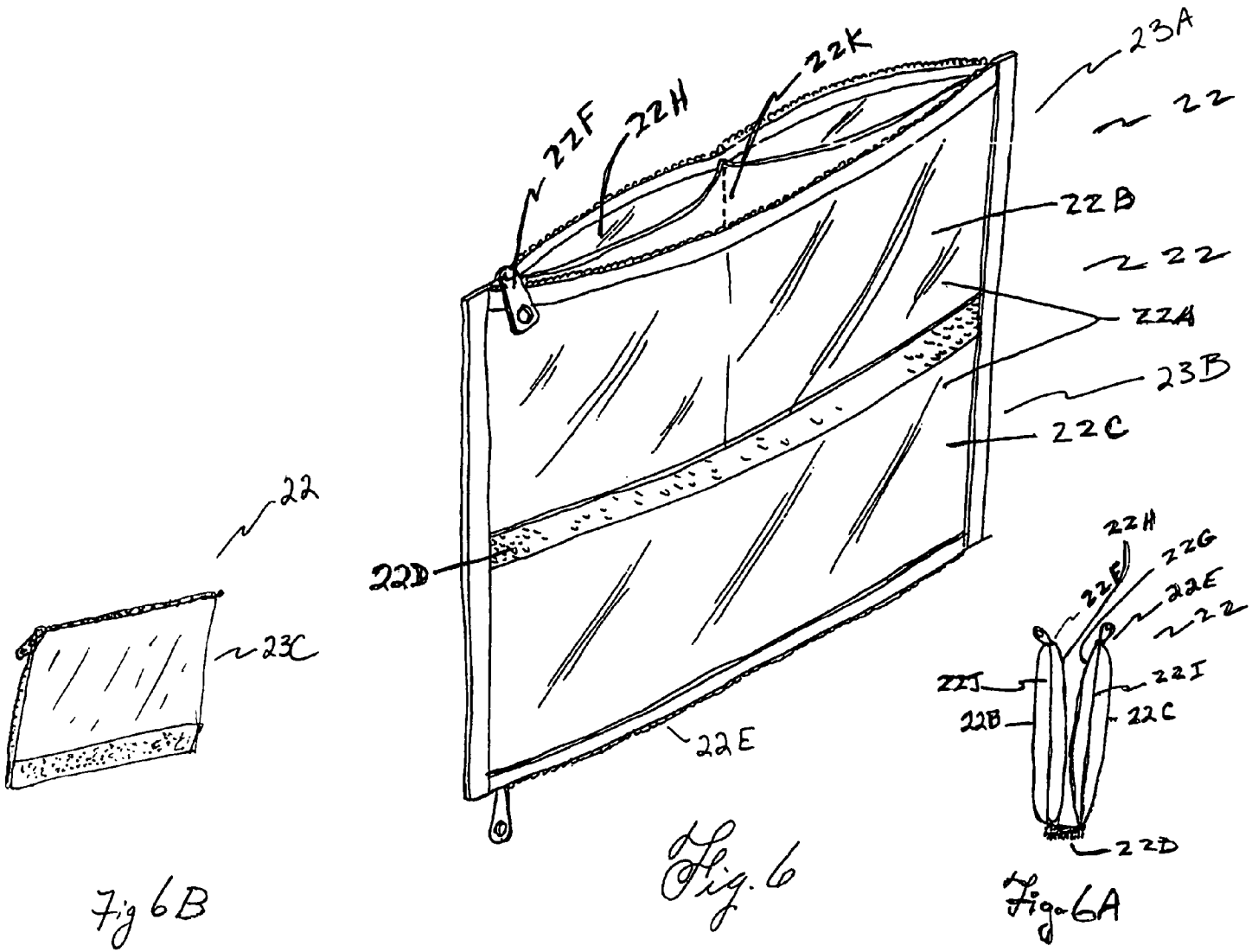
FIG. 6 is a perspective view of a leaf pocket removed from the panel.
FIG. 6A is a side elevational view, cutaway, of a leaf pocket.
FIG. 6B is a perspective view of a single sheath pocket.

FIGS. 6 and 6A illustrate details of a leaf pocket (22) of Applicant's present invention. As is noted earlier, the leaf pocket is generally thin and tabular in nature. Further, a leaf pocket such as that illustrated may have an outer cover (22A) comprising a front wall (22B) and a back wall (22C), the front and back wall separated by a Velcro spine (22D) which may attach to the inner surface of the panel either to a mounting panel or directly to a matching strip as set forth in FIGS. 2 and 3. Note in FIG. 6A that the leaf pocket (22) may be folded to represent a pair of parallel laying sheaths or leaves, and wherein at least part of walls (22B and 22C) are clear. Zippers (22E and 22F) provide easy access to the interior of the leaf pockets. Other pocket closure structures may include Velcro®, plastic slides, snaps or the like. Typically, a pair of interior walls (22H and 22G) are spaced apart and generally parallel to outer walls (22B and 22C) as set forth in FIG. 6A. There may also be an opaque interior member (22I and 22J) between the inner and outer walls, which opaque member would separate into two compartments (23A and 23B) a compartment defined by wall pairs (22C and 22G) on the one hand and (22B and 22H) on the other. That is, in a preferred embodiment of Applicant's present invention, wall members (22C and 22G) may be non-opaque and may be separated by opaque wall (22I). Likewise, walls (22B and 22H) may be non-opaque and separated by opaque wall (22J). Zippers may provide access to compartments (23A and 23B) and the compartments may be further subdivided as by stitching (22K).

FIGS. 6 and 6A illustrate a removable pocket having a pair of compartments (23A and 23B) removably connected to the surface of the container at spring leaf (22D). In an alternate embodiment illustrated in FIG. 6C, a single compartment (23C) pocket (22) is illustrated with a Velcro strip and typically at least one clear and one opaque wall.

Figure 8A:
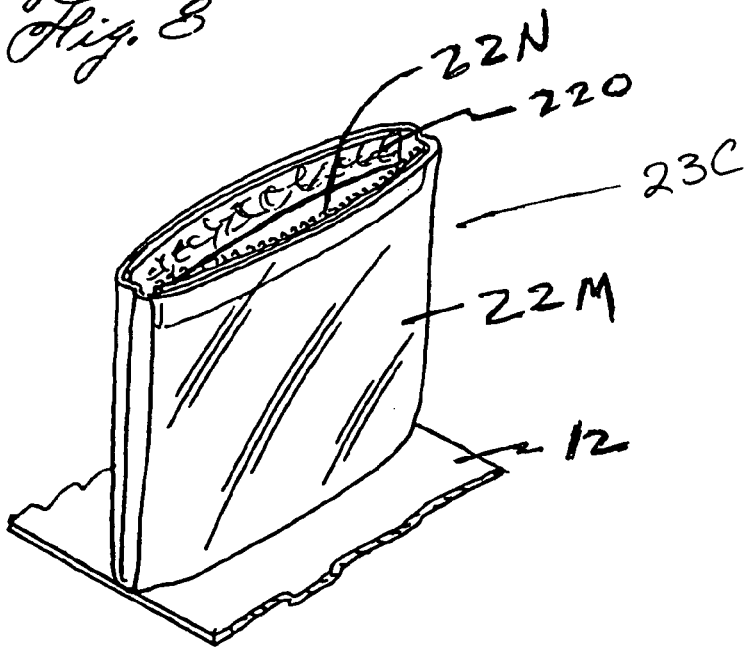

Turning for a moment to FIGS. 6B and 8A and further with reference to FIG. 2, note that Applicant may provide an alternate preferred embodiment of leaf pocket (23C) here and comprising a single sheath or leaf having a pair of walls (22N and 22M) defining an interior compartment sealed at one end adjacent to panel (12) and releasably opened, as by zipper or Velcro (22O). Note that either of the disclosed embodiments of the leaf pocket may be either directly attached to panel (12) or may be attached to a mounting panel (30) which may be removed as by Velcro or the like from the inner or outer surface of the panel. Thus, there may be a variety of combinations of leaf pockets and mounting means, for engagement with the panel. Either type of leaf pocket may be either directly attached to mounting panel as in FIG. 8, in which case a multiplicity of leaf pockets may be attached to be removed at one time from the panel, or, either type of leaf packet may be individually attached, releasably or permanently (as by sewing), to the inner surface of the panel.

Figure 3:
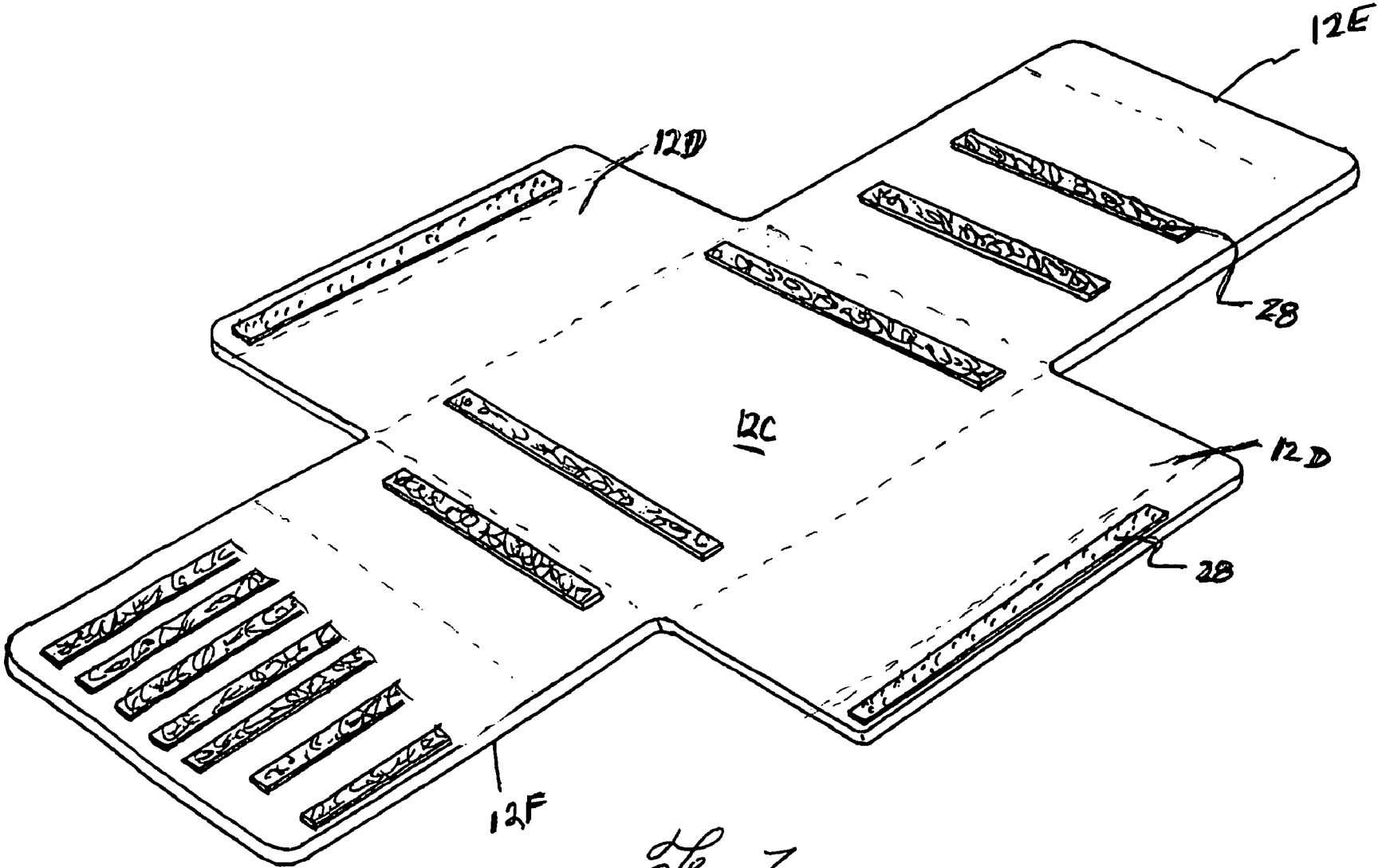
FIG. 3 is a perspective view of the panel comprising apart of Applicant's novel container, the panel with the pockets removed therefrom.
Figure 7:
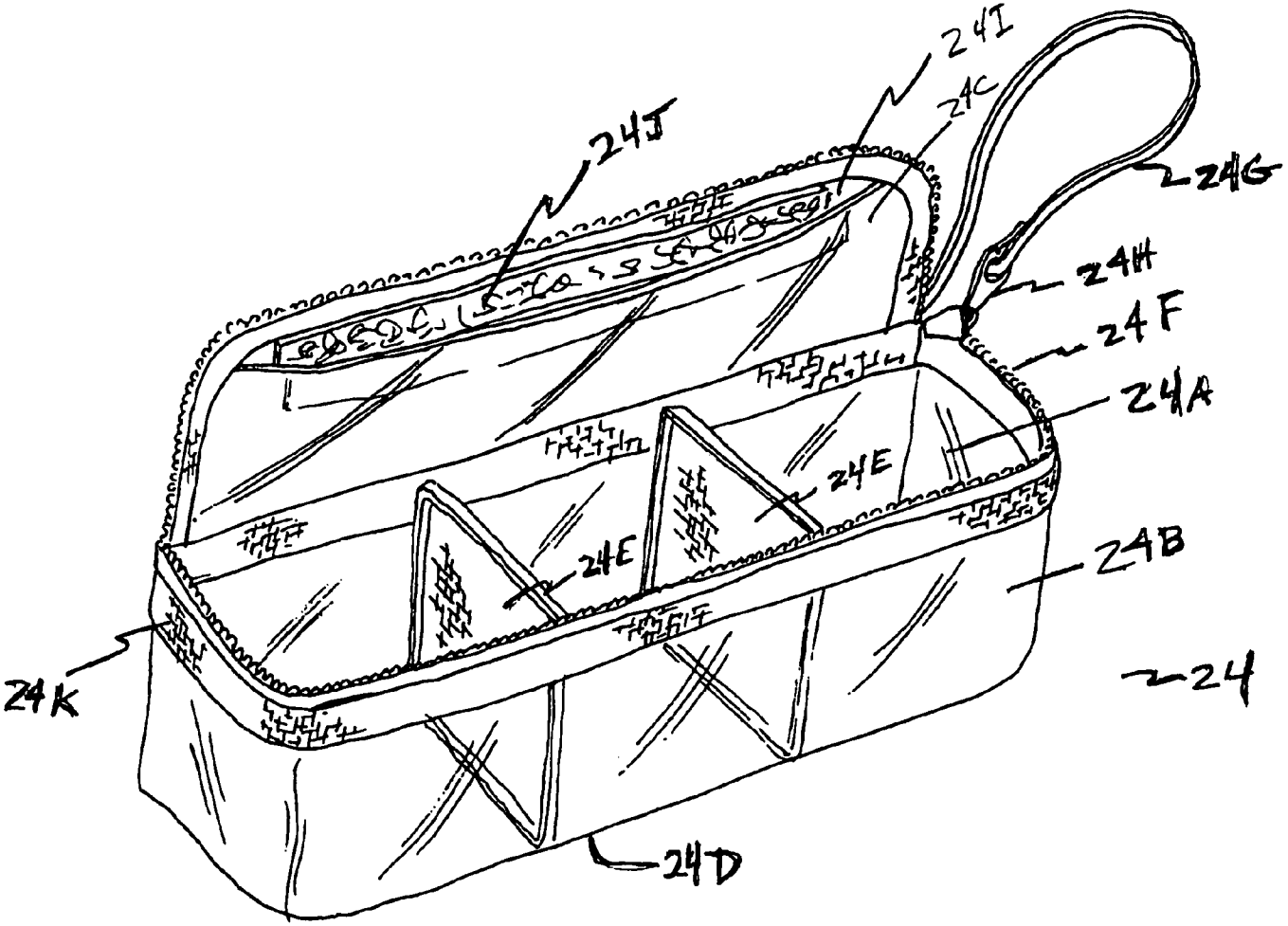
FIG. 7 is a perspective view of a bulk pocket removed from the panel.

FIG. 7 illustrates a bulk pocket (24) which is readily distinguishable from the leaf pocket in having three substantial dimensions: length, width and height, and therefore more adaptable to carrying bulky items. Further, bulk pocket (24) is seen to include an interior space (24A) defined by side walls (24B) (here four), a zippered opening top wall (24C) and a bottom wall (24D), opposite the top wall. Further, it may be seen that interior volume (24A) may be subdivided as by pocket panels (24E) which pocket panels may be opaque and/or non-opaque. Indeed, typically, at least some of the side walls, top wall and bottom wall of the bulk pockets may be clear (optionally) for the user to view the contents thereof. In another embodiment the pocket walls may be opaque. A zipper (24F) or other opening means is typically provided as is a handle, such as a strap (24G), one end of which may be attached to the zipper handle (24H) as illustrated in FIG. 7. In a preferred embodiment of bulk pocket (24) illustrated in FIG. 7, a second interior compartment (24I) is provided by having a top wall (24C) made of two sheets with Velcro attaching them along one border (24J). Rear enforcement strip (24K) may be provided and, where it trends along a side wall, such as the side wall on which top wall (20C) pivots, a portion of a Velcro attachment strip may be provided which in turn would mate with a Velcro attachment strip on the inner surface (12B) of panel (12) as illustrated in FIG. 3 (bulk pockets removed) and FIG. 2 (bulk pockets present).

Turning to FIG. 2, it is seen that bulk pockets may be provided in a variety of sizes, as leaf pockets are. Typical dimensional ranges for these may be L about 3 to 11 inches, W about ½ to 1 inch, and H about 3 to 11 inches. Providing both bulk and leaf pockets and further providing each of these in different sizes provides a unique assemblage of pockets which a variety of various sized items may be stored and, which can be easily be identified since one or more of the walls of the pockets are typically non-opaque. Further, pockets can individually be removed or be removed as a group. All of these features, including the feature of a removable insert pack, provide unprecedented capabilities heretofore not found in prior art luggage containers.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. A container comprising:

a panel adapted to lay flat in a first position and adapted to be folded into a generally rectangular shell in a second position, the rectangular shell having a top wall, a bottom wall, a back wall, a rear wall, and two side walls, the top wall, back wall, bottom wall and rear wall adapted to lay along a first axis and pivotally engage one another and two side walls spaced laterally from the back wall and pivotally engaged therewith, the back wall pivotally attached to both the top wall and the bottom wall, each of the side walls having a removed edge adapted to removably engage a pair of spaced apart edges of the rear wall, wherein the walls of the panel define a second axis, the two side walls and the back wall laying along the second axis, the second axis being perpendicular to the first axis, the shell defining an inner volume, the panel having an inner and outer surface;

a multiplicity of rectangular leaf pockets, each leaf pocket having a front and a rear wall defining inner volume and a having a top edge adapted to open and close to provide access to the inner volume defined by the front and the rear wall and by the top edge and the bottom edge, the bottom edge being spaced apart and parallel to the top edge and the bottom edge being pivotally attached to one of the walls of the panel, the bottom edges of adjacent leaf pockets spaced apart from one another such that the leaf pockets overlap in a staggered fashion including means to removably attach leaf pockets to the inner surface of the wall of the panel;

a multiplicity of bulk pockets including means to removeably attach one or more of the bulk pockets to the inner surface of the panel;

wherein at least some of the multiplicity of bulk pockets and the multiplicity of leaf pockets are comprised of walls, at least some of which are non-opaque;

wherein at least some of either the leaf pockets or the bulk pockets are on the inner surface of the back and the rear walls;

a pair of shoulder straps engaging the outer surface of the panel in spaced apart relation near where the top wall and back wall meet.

2. The container of claim 1 further including pockets adapted to be attached to the outside surface of the panel.

3. The container of claim 1 further including an insert pack dimensioned to fit within the inner volume of the rectangular shell.

4. The container of claim 3 further including means to removably secure the insert pack to the inner surface of the panel.

5. The container of claim 1 wherein at least some of the bulk pockets have walls defining a multiplicity of compartments and handles.

6. The container of claim 1 wherein at least some of the leaf pockets have walls defining a multiplicity of compartments.

7. The container of claim 1 wherein means to removably attach the leaf pockets includes hook and loop strips, the hook strip for attachment to either the leaf pocket or the inner surface of the panel, the loop strip for attachment to the other of the leaf pocket or the inner surface of the panel.

8. The container of claim 1 wherein means to removably attach the bulk pockets includes hook and loop strips, the hook strip for attachment to either the bulk pocket or the inner surface of the panel, the loop strip for attachment to the other of the bulk pocket or the inner surface of the panel.

9. The container of claim 1 wherein means to removably attach the leaf pockets to inner surface of the panel includes a mounting panel.

10. The container of claim 1 wherein at least some of the multiplicity of leaf pockets are similarly dimensioned and are pivotally mounted to the inner panel and lay adjacent and parallel to one another.

11. The container of claim 1 wherein the leaf pockets of the multiplicity of pockets are comprised of a pair of sheaths.

12. The container of claim 1 wherein at least some of the leaf pockets include labels or indicia to identify the contents thereof.

13. The container of claim 1 wherein the multiplicity bulk pockets include bulk pockets of a first size and bulk pockets of a second size, the first and the second sizes being different.

14. The container of claim 1 wherein at least some of the multiplicity of bulk pockets include a top wall, the top wall of the at least some of the multiplicity bulk pockets including a top wall pocket thereon.

15. The container of claim 1 wherein the panel includes hook and pile fasteners to releasably secure the panel in the second position.

16. The container of claim 1 further including panel pockets adapted to be attached to the outside surface of the panel, and further including an insert pack dimensioned to fit within the inner volume of the rectangular shell.

17. The container of claim 1 wherein at least some of the bulk pockets have walls defining a multiplicity of compartments and wherein at least some of the bulk pockets are non-opaque.

18. The container of claim 1 wherein means to removably attach the leaf pockets includes hook and loop strips, the hook strip for attachment to either the leaf pocket or the inner surface of the panel, the loop strip for attachment to the other of the leaf pocket or the inner surface of the panel; and wherein means to removably attach the bulk pockets includes hook and loop strips, the hook strip for attachment to either the bulk pocket or the inner surface of the panel, the loop strip for attachment to the other of the bulk pocket or the inner surface of the panel.

19. The container of claim 1 further including pockets adapted to be attached to the outside surface of the panel; further including an insert pack dimensioned to fit within the inner volume of the rectangular shell, wherein at least some of the leaf pockets include labels to indicia to identify the contents thereof, wherein the multiplicity bulk pockets include bulk pockets of a first size and bulk pockets of a second size, the first and the second sizes being different.

20. The container of claim 1 wherein means to removably attach the leaf pockets to inner surface of the panel includes a mounting panel, wherein at least some of the multiplicity of leaf pockets are similarly dimensioned and are pivotally mounted to the inner panel and lay adjacent and parallel to one another.

21. A container comprising:

a panel adapted to lay flat in a first position and adapted to be folded into a generally rectangular shell in a second position, the shell having a top wall, a bottom wall, a back wall, a rear wall, and two side walls, the top wall, back wall, bottom wall and rear wall adapted to lay along a first axis and pivotally engage one another and two side walls spaced laterally from the back wall and pivotally engaged therewith, the back wall pivotally attached to both the top wall and the bottom wall, each of the side walls having a removed edge adapted to removably engage a pair of spaced apart edges of the rear wall, wherein the walls of the panel define a second axis, the two side walls and the back wall laying along the second axis, the second axis being perpendicular to the first axis, the shell defining an inner volume, the panel having an inner and outer surface;

a multiplicity of rectangular leaf pockets, each leaf pocket having a front and a rear wall defining inner volume and a having a top edge adapted to open and close to provide access to the inner volume defined by the front and the rear wall and by the top edge and the bottom edge, the bottom edge being spaced apart and parallel to the top edge and the bottom edge being pivotally attached to one of the walls of the panel, the bottom edges of adjacent leaf pockets spaced apart from one another such that the leaf pockets overlap in a staggered fashion including means to removably attach leaf pockets to the inner surface of the wall of the panel;

a multiplicity of bulk pockets including means to removeably attach one or more of the bulk pockets to the inner surface of the panel;

wherein at least some of the multiplicity of bulk pockets and the multiplicity of leaf pockets are comprised of walls, at least some of which are non-opaque;

wherein at least some of either the leaf pockets or the bulk pockets are on the inner surface of the back and the rear walls;

a pair of shoulder straps engaging the outer surface of the panel in spaced apart relation near where the top wall and back wall meet.

* * * * *

UNITED STATES PATENT AND TRADEMARK OFFICE

CERTIFICATE OF CORRECTION

PATENT NO. : 7,600,619 B2
APPLICATION NO. : 10/856148
DATED : October 13, 2009
INVENTOR(S) : Rachel Sapyta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1097 days.

Signed and Sealed this

Fifth Day of October, 2010

David J. Kappos

David J. Kappos
*Director of the United States Patent and Trademark Office*